US010865568B2

(12) United States Patent
Nunley

(10) Patent No.: US 10,865,568 B2
(45) Date of Patent: Dec. 15, 2020

(54) STABILIZED HORIZONTAL ROOF DECK ASSEMBLIES

(71) Applicant: Loadmaster Systems, Inc., Peachtree Corners, GA (US)

(72) Inventor: Charles Lynn Nunley, Peachtree Corners, GA (US)

(73) Assignee: Loadmaster Systems, Inc., Peachtree Corners, GA (US)

( * ) Notice: Subject to any disclaimer, the term of this patent is extended or adjusted under 35 U.S.C. 154(b) by 0 days.

(21) Appl. No.: 15/888,060

(22) Filed: Feb. 4, 2018

(65) Prior Publication Data

US 2019/0242134 A1 Aug. 8, 2019

(51) Int. Cl.

| | |
|---|---|
| ***E04D 3/36*** | (2006.01) |
| ***E04D 3/35*** | (2006.01) |
| ***E04D 11/02*** | (2006.01) |
| *E04B 7/02* | (2006.01) |

(52) U.S. Cl.

CPC ..... *E04D 3/3606* (2013.01); *E04D 3/352* (2013.01); *E04D 3/3603* (2013.01); *E04D 11/02* (2013.01); *E04B 7/022* (2013.01)

(58) Field of Classification Search

CPC ..... E04D 3/3606; E04D 11/02; E04D 3/352; E04D 3/3603

See application file for complete search history.

(56) References Cited

U.S. PATENT DOCUMENTS

| | | | | | |
|---|---|---|---|---|---|
| 3,914,916 | A * | 10/1975 | Simpson | E04B 7/22 | 52/748.1 |
| 4,223,486 | A * | 9/1980 | Kelly | E04D 13/17 | 52/1 |
| 4,736,561 | A * | 4/1988 | Lehr | E04D 11/02 | 52/199 |
| 4,862,664 | A * | 9/1989 | Romine | E04D 3/3603 | 52/410 |
| 4,884,932 | A * | 12/1989 | Meyer | E04D 3/3603 | 411/373 |
| 4,965,977 | A * | 10/1990 | White | E04D 3/351 | 52/410 |
| 4,991,248 | A | 2/1991 | Allen | | |
| 5,584,153 | A | 12/1996 | Nunley et al. | | |
| 5,644,880 | A * | 7/1997 | Lehnert | B28B 19/0092 | 52/309.17 |
| 5,884,446 | A * | 3/1999 | Hageman | E04D 11/02 | 52/309.8 |
| 6,088,992 | A | 7/2000 | Nunley | | |
| 6,250,036 | B1 * | 6/2001 | Nurley | E04D 3/3606 | 52/408 |

(Continued)

*Primary Examiner* — Adriana Figueroa

(74) *Attorney, Agent, or Firm* — Peter V. Schroeder; Booth Albanesi Schroeder PLLC

(57) ABSTRACT

A horizontal roof deck assembly has a ribbed steel roof deck sufficiently strong to withstand specified gravity, uplift, and shear loads. Rigid substrate boards are positioned adjacent one another above the deck, defining end and side joints. End joints are parallel to and above a corresponding upper rib of the roof deck and are secured to the upper rib by compression disk fasteners spaced along the end joint. The side joints can be tongue and groove joints. Additional fasteners attach the substrate boards to the roof deck along the side joints, for wind uplift resistance, and for thermal movement resistance.

6 Claims, 5 Drawing Sheets

(56) References Cited

U.S. PATENT DOCUMENTS

| | | | | |
|---|---|---|---|---|
| 6,312,541 | B1 | 11/2001 | Hemphill | |
| 6,945,005 | B2 | 9/2005 | Nunley | |
| 7,779,592 | B2 * | 8/2010 | Bernardi | E04D 3/3603 411/545 |
| 9,422,725 | B1 * | 8/2016 | Brookheart | E04D 13/172 |
| 9,702,155 | B2 * | 7/2017 | Nunley | E04G 23/0281 |
| 9,856,651 | B2 * | 1/2018 | Letts | E04D 3/3603 |
| 10,100,524 | B2 * | 10/2018 | Freeman | E04D 15/04 |
| 10,155,360 | B2 * | 12/2018 | Harrison | G01K 1/14 |
| 2001/0018815 | A1 | 9/2001 | Nunley et al. | |
| 2004/0109983 | A1 * | 6/2004 | Rotter | B32B 5/18 428/143 |
| 2006/0099370 | A1 * | 5/2006 | Glass | B32B 3/266 428/40.1 |
| 2009/0208714 | A1 * | 8/2009 | Currier | B28B 1/52 428/212 |
| 2015/0040503 | A1 * | 2/2015 | Tackett | E04D 11/02 52/309.4 |
| 2015/0284960 | A1 * | 10/2015 | Bleibler | E04D 5/143 156/64 |
| 2017/0058523 | A1 * | 3/2017 | Kennedy | E04D 5/06 |

* cited by examiner

STABILIZED HORIZONTAL ROOF DECK ASSEMBLIES

BACKGROUND

A typical commercial flat roof assembly is of layered or "built-up" construction. A roof deck is attached to purlins or other structural members of the building. The roof deck can be corrugated or flat and is a high-strength structural component designed to carry the loads placed on the roof and to, considered alone, meet roof load requirements. (Not considered herein are "composite strength roofs" which rely on the combined strength characteristics of their components, as installed, to meet load requirements and where the components considered individually are insufficient to meet those requirements.) The horizontal roof deck assembly is built-up over the roof deck itself by adding layers of insulation and rigid board substrate on top of the deck. Further layers can be added for waterproofing, thermal capacitance, appearance, walking surface, etc. The insulation layer and rigid board substrate is applied by positioning a large number of panels or boards adjacent one another across the roof surface. Joints are formed where adjacent panels abut.

As the roofs age, changing gravitational, wind uplift, shear, and thermal loads cause relative movement of the adjacent panels, compromising the integrity of the upper layers of the roof assembly, especially along the joints. Subsequent leaks, cracks, split seams, etc., eventually cause a failure requiring repair or replacement of the roof substrate and insulation.

BRIEF DESCRIPTION OF THE DRAWING

A drawing of exemplary embodiments of the disclosure are annexed hereto so that the disclosure may be better and more fully understood, in which.

Numeral references are employed to designate like parts throughout the various figures of the drawing.

DESCRIPTION OF PREFERRED EMBODIMENTS

Figure 1:
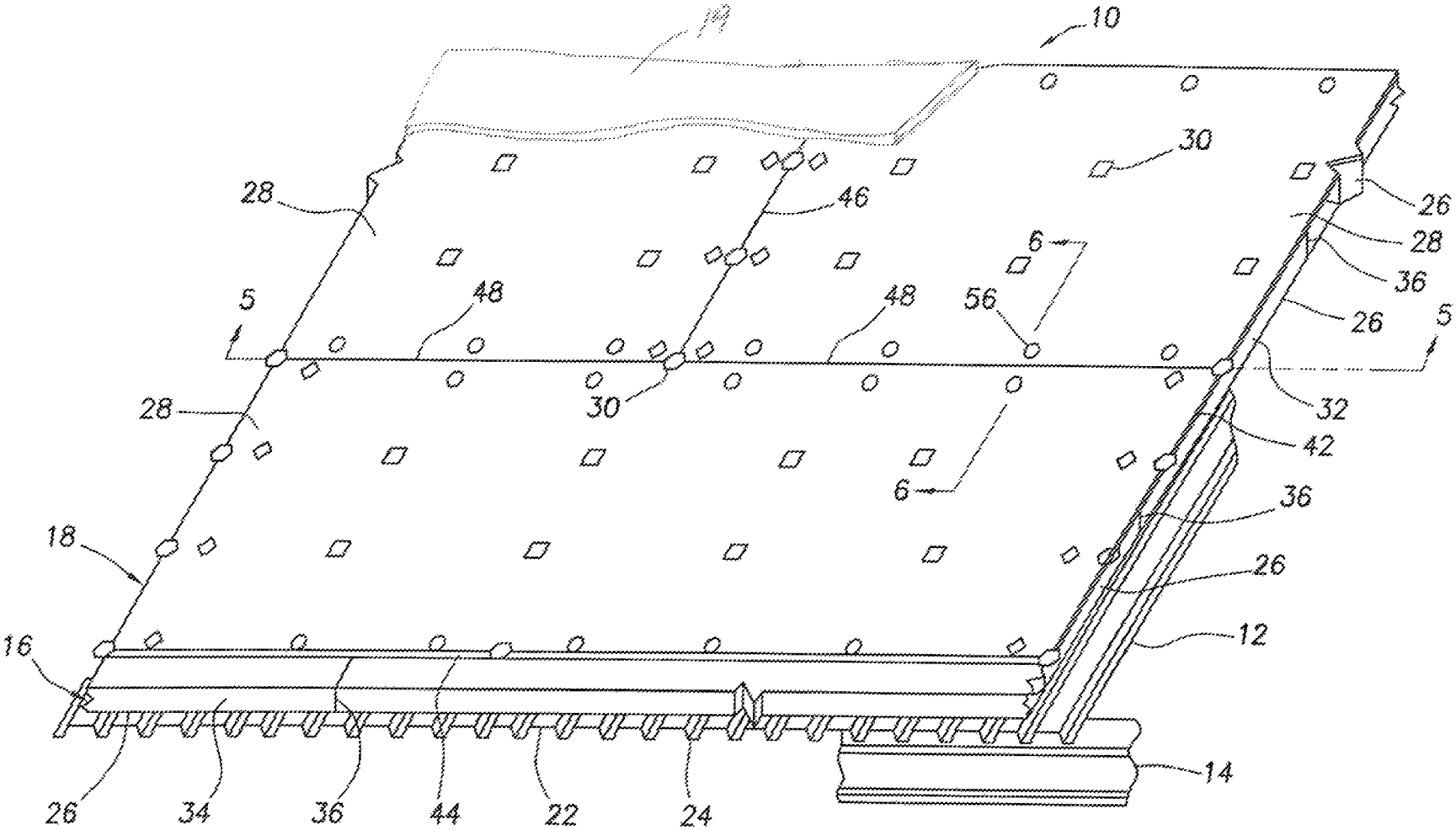
FIG. 1 is an isometric illustration of an exemplary horizontal roof deck assembly, generally designated 10, and having a corrugated steel deck secured to horizontal supports and overlaid with a built-up roof.

The steel roof decks referenced herein are either flat steel roof deck or corrugated steel roof deck and are formed in generally flat sheets. The corrugated roof deck has parallel stiffening ribs extending across the sheet forming upper and lower ribs. The flat surfaces of the upper ribs provide a supporting surface for one or more layers of rigid sheet material such as insulation or rigid substrate. Symmetrically corrugated deck has been historically used for roof assemblies, however non-symmetric deck is also known.

The steel roof decks addressed herein are high-strength steel and are designed to be and are capable individually of supporting the various loads expected to be encountered by the roof assembly. The steel roof decks addressed herein are capable individually of supporting the shear, diaphragm, uplift, and gravity loads according to the roofing specifications. That is, the roof assemblies considered herein are specifically understood to not include "composite strength" roof assemblies which rely on the combined strength characteristics of their components, as installed, to meet load requirements and where the components considered individually are insufficient to meet those requirements. Composite strength roofing relies on the composite strength of the connected components of the assembly rather than the strength characteristics of components individually.

Historically, flat built-up roof assemblies and structural steel supports used mild-steel roof decks having much higher weights and requiring correspondingly more support. For example, mild steel roof decks and joists might require supporting joists weighing 12 pounds per linear foot. As high-strength steel roof decks and steel joists became the norm, less support was required to hold the deck structure. For example, supporting joists might meet load requirements even at the relatively light-weight of 4 pounds per foot. The high-strength steel decks and steel joists, however, are relatively flexible and move more significantly under high loading, such as flexural and wind uplift loads for example. Such movement places correspondingly higher stress on the built-up layers above the roof deck, especially at the joints of those layers.

Additional layers may be built up on roof deck assemblies, such as roof coverings, insulations, sloped insulations for slopes and drainage, protective layers, earth layers, decorative layers and walkways. For example, additional layers of 3-ply felt with tar and a gravel surface have been a common configuration. An insulation layer can be provided and can be a soft, semi-rigid or rigid insulation and is typically installed just above the roof deck.

Roof cover boards and roof insulation are commonly installed over structural steel decks and attached with threaded fasteners. With the development of soft, single-ply roof coverings it became popular to apply a membrane over soft insulation without additional rigid layers above. Membrane roofing is designed to move water from the roof. Membrane roofs are commonly made from rubber, plastic, thermoplastic, or modified bitumen. This led to many roof failures from punctures, etc. Consequently, denser rigid roof cover boards have been added below the roofing membrane and above the insulation to support the weak membrane. Such roof cover boards are made of various materials, most commonly gypsum, high-density plastic, and cement.

The boards come in many sizes with the most popular being ½ inch by 4 feet by 8 feet. The rigid cover boards are subject to wind uplift, of course, and threaded fasteners are applied to prevent the boards from blowing off the building and taking the roofing membrane with it. Such fasteners are applied away from the board joints and proximate the center of the boards and are designed to prevent the boards from lifting off the roof deck. Such fasteners and placement do nothing to assure joint stability. No consideration or treatment is provided to stabilize the joints between the cover boards.

Roof coverings can be mechanically attached with threaded fasteners or fully adhered with various types of adhesive methods. Roof cover boards provide a suitable surface to which to adhere the roofing membranes 19. Fully adhered membranes 19 positioned over cover boards has become a preferred method of constructing the roof deck assembly.

A major problem with built-up roof assemblies, especially those with rigid substrate boards 18, whether under membrane 19, over insulation 16 or other material, is failures of the roof covering at and along the joints of the boards 18. The joints 46 and 48 are natural weak points subject to relative movement under thermal changes, wind uplift loads, and diaphragm shear loads for example. The joints 46 and 48 are also natural locations for leaks and cracking and degradation of roofing substrate and other materials. Substrate boards lacking reinforcing materials are subject to cracking and breaking when placed under flexural loads during installation on an uneven roof assembly or under post-completion loading. All of these elements lead to eventual roof covering failure and relatively early repair and replacement. These problems would be lessened or eliminated if the roof acted more as a monolithic unit and less as a bunch of relatively movable panels, resulting in extended life of the roof covering.

To reduce these problems and extend the life of the roof covering, the inventors disclose herein apparatus and methods for building a substantially horizontal, built-up roof deck assembly having a corrugated, high-strength steel roof deck, having sufficient strength to withstand predetermined gravity, wind uplift, and diaphragm shear loads on the roof assembly, and having a layer of rigid substrate boards 18 arranged and attached to the roof deck 12 in such a way as to minimize relative movement of the boards 18 and failures of the roof covering 19 at or because of the joints 46 and 48 between the boards. In various embodiments, the boards 18 are selectively positioned in relation to the roof deck corrugations, to each other, and to sub-layer panels (if any), adjacent boards are provided with interlocking mechanisms, sufficient and selected types of fasteners are attached to the boards 18 and roof deck 12, and the fasteners are arranged to prevent relative movement of the substrate boards.

FIG. 1 is an orthogonal, partial cut-away view illustration of an exemplary roof deck assembly according to aspects of the disclosure. Flat roofs are substantially horizontal, typically between zero and three degrees from horizontal or have a slope ranging from about 0.25/12 to 2/12. The roof deck assembly 10 is comprised of a high-strength steel roof deck 12 supported by and attached to horizontal supports 14, such as steel purlins, rafters, beams, joists and the like. Attached to the roof deck are layers of roofing assembly, such as a rigid or semi-rigid insulation layer 16 and a rigid substrate layer 18.

The insulation layer 16 is typically made up of a plurality of insulation panels 26 placed adjacent one another. Similarly, the rigid substrate 18 is made up of a plurality of rigid substrate boards 28 positioned adjacent one another. The insulation layer and rigid substrate are attached to the roof deck by a plurality of fasteners 30.

Figure 2:
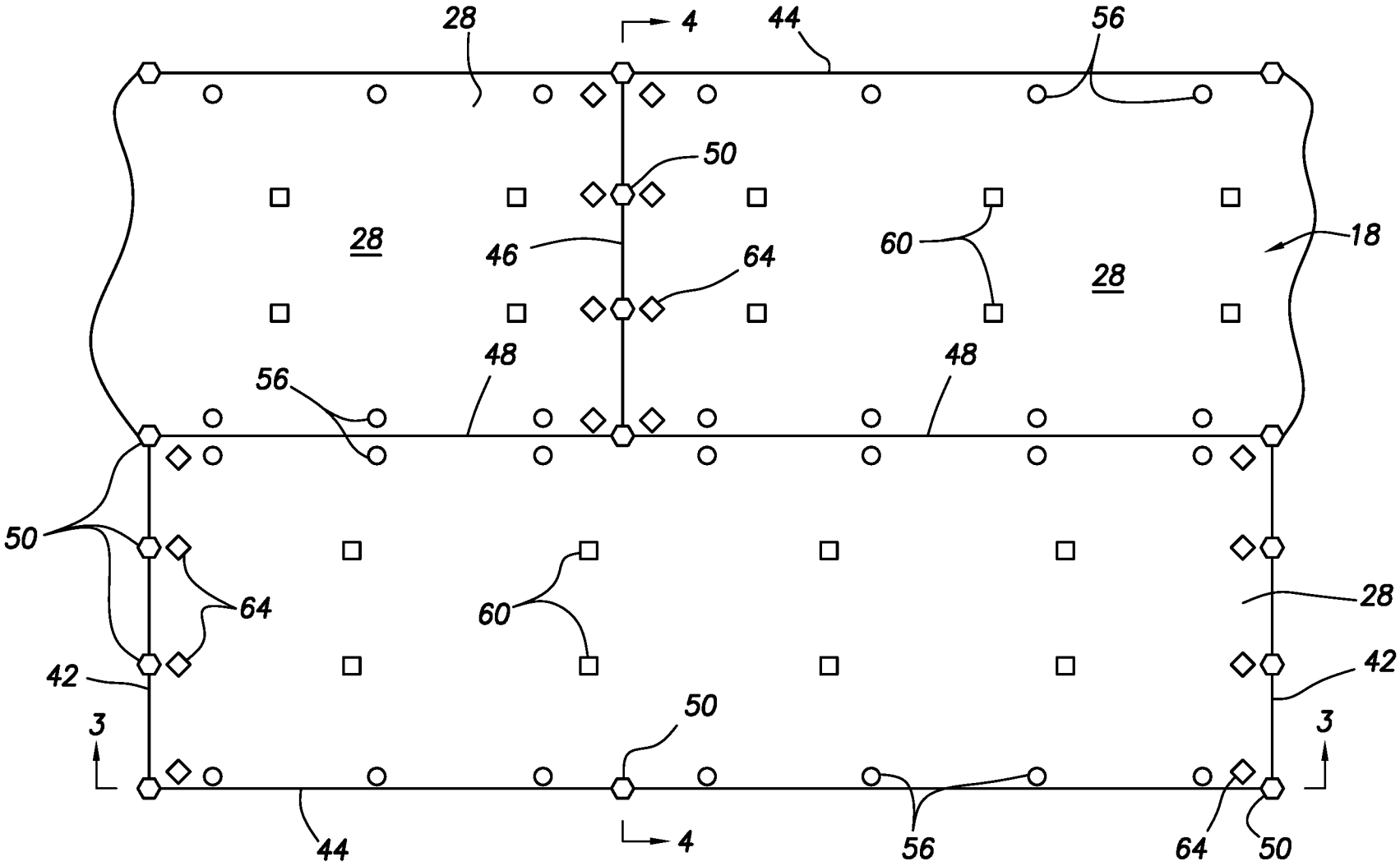
FIG. 2 is a top view of an exemplary embodiment of a roof deck assembly according to aspects of the disclosure.
Figure 3:
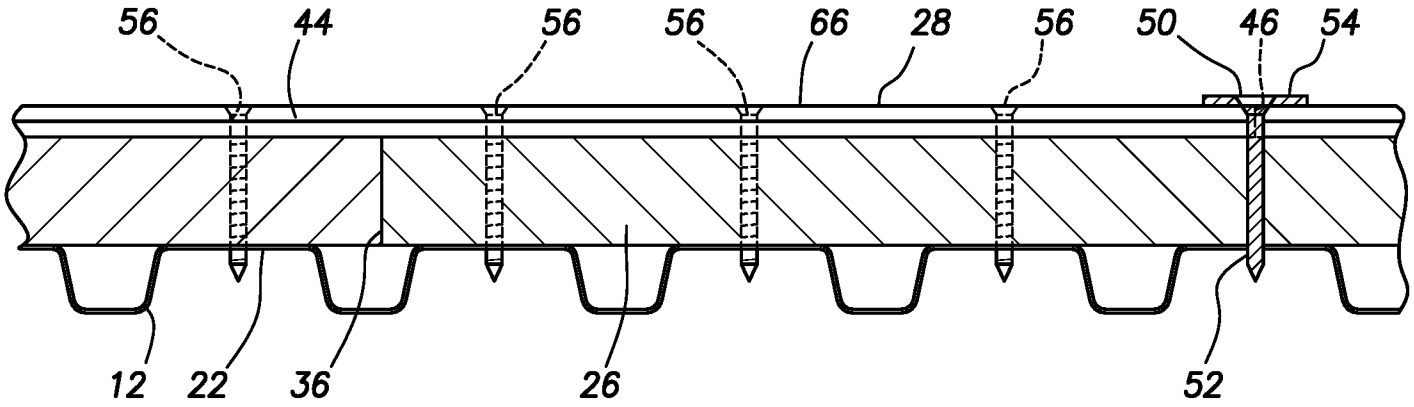
FIG. 3 is a side elevational cross-sectional view taken along a portion of line 3-3 as indicated in FIG. 2 of a roof deck assembly according to aspects of the disclosure.
Figure 4:
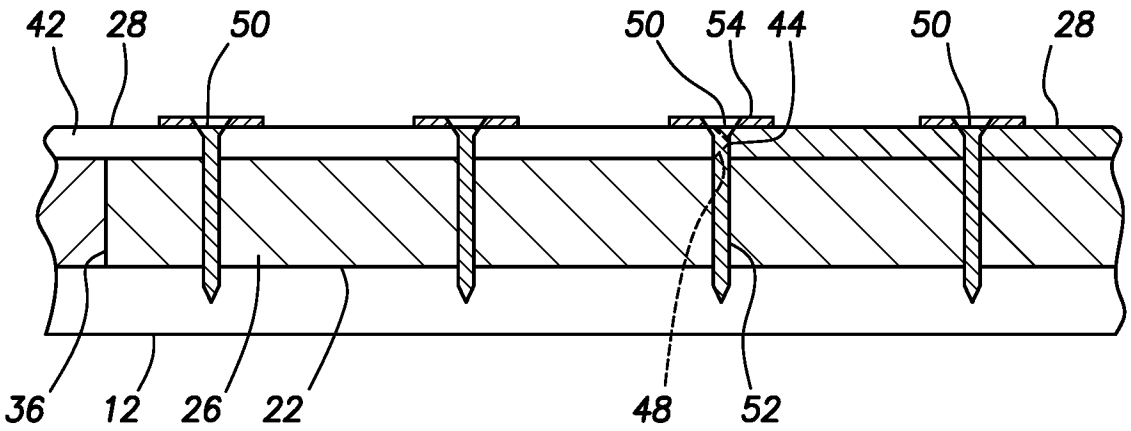
FIG. 4 is an end elevational cross-sectional view taken along a portion of line 4-4 as indicated in FIG. 2 of a roof deck assembly according to aspects of the disclosure.
Figure 5:
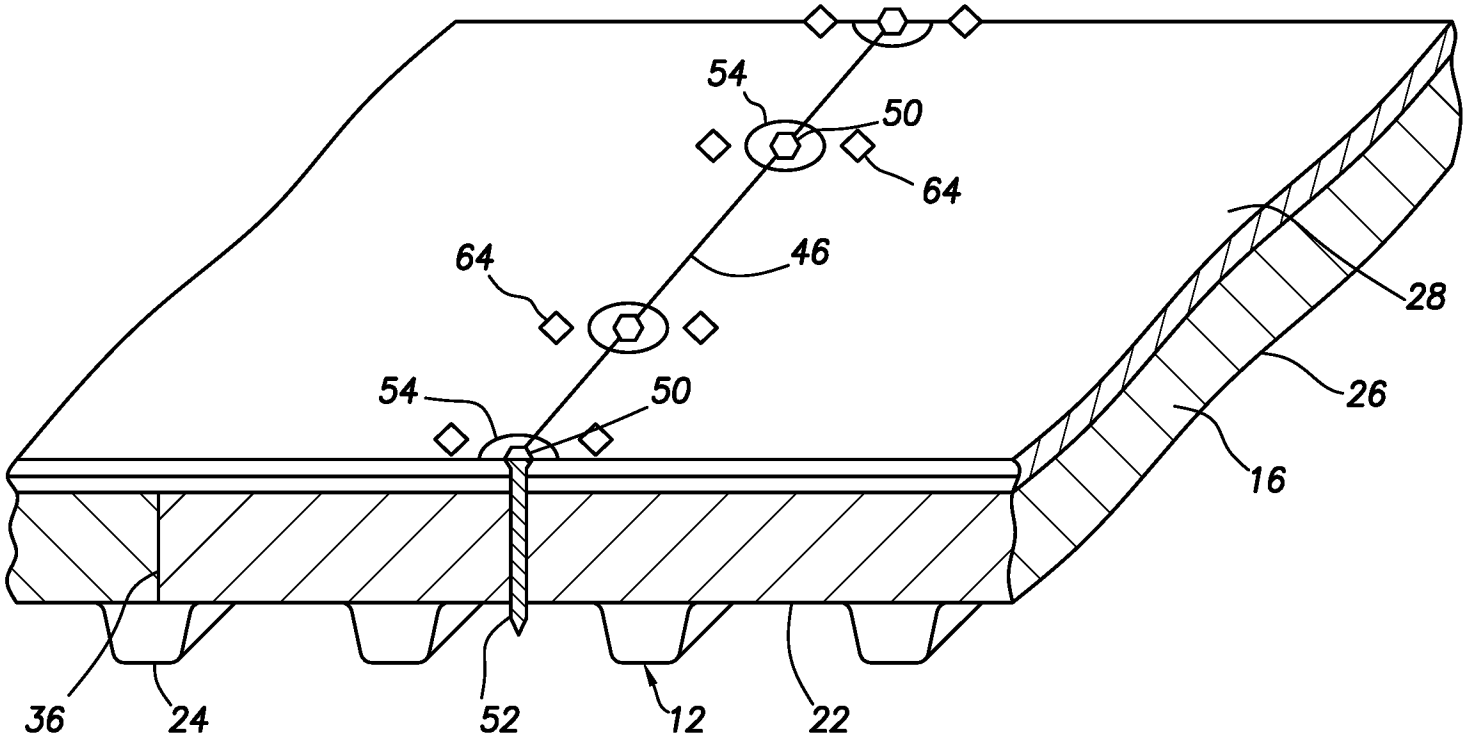
FIG. 5 is a detail orthogonal view taken along a portion of line 5-5 at an end joint of a roof deck assembly according to aspects of the disclosure.
Figure 6:
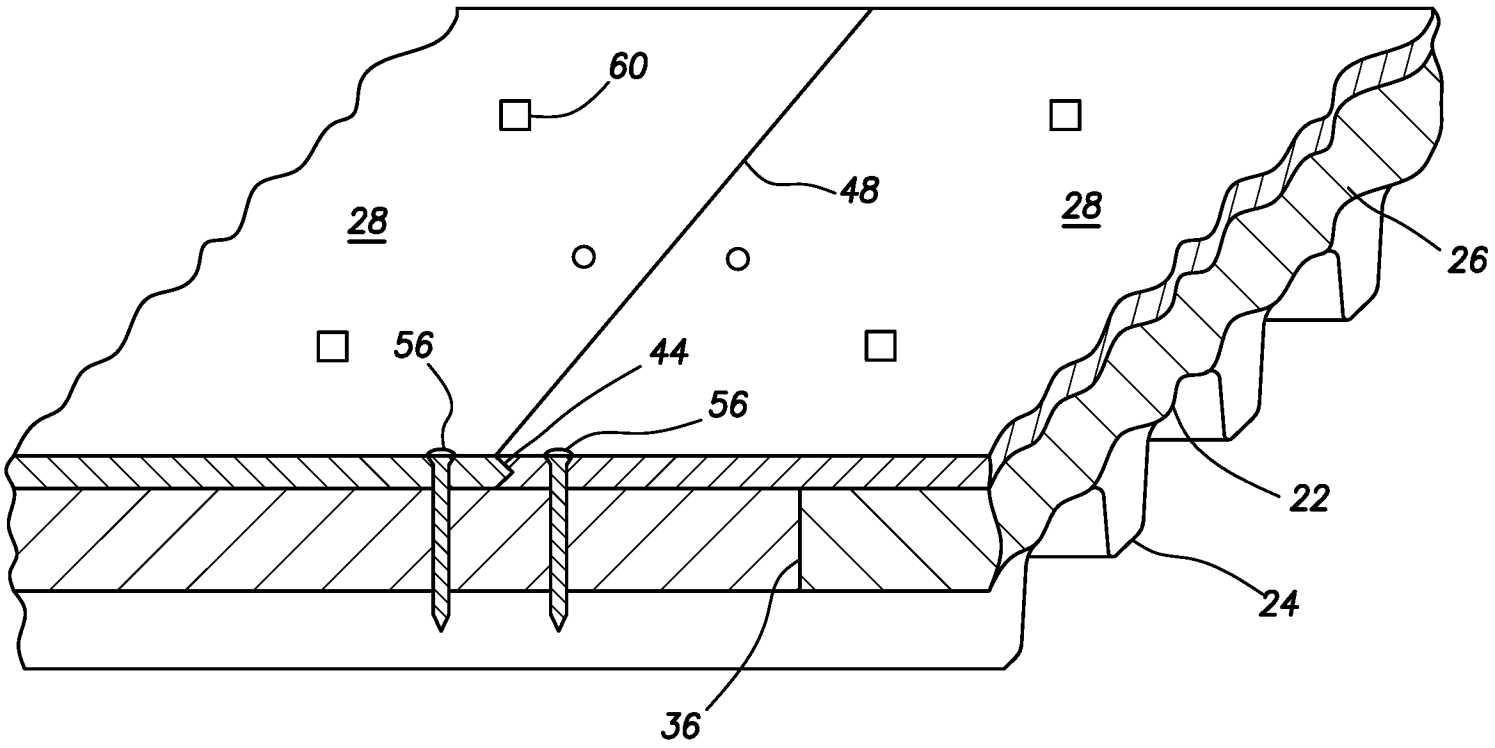
FIG. 6 is a detail orthogonal view taken along a portion of line 6-6 at a side joint of a roof deck assembly according to aspects of the disclosure.

FIG. 2 is a top view of an exemplary embodiment of a roof deck assembly according to aspects of the disclosure. FIG. 3 is a side elevational cross-sectional view taken along a portion of line 3-3 as indicated in FIG. 2 of a roof deck assembly according to aspects of the disclosure. FIG. 4 is an end elevational cross-sectional view taken along a portion of line 4-4 as indicated in FIG. 2 of a roof deck assembly according to aspects of the disclosure. FIG. 5 is a detail orthogonal view taken along a portion of line 5-5 at an end joint of a roof deck assembly according to aspects of the disclosure. FIG. 6 is a detail orthogonal view taken along a portion of line 6-6 at a side joint of a roof deck assembly according to aspects of the disclosure. The Figures are not to scale, and especially the fasteners, screws, compression washers and the like are not drawn to scale. Further, the positioning of the fasteners is exemplary and may vary between Figures. For example, fasteners shown in cross-section may appear more closely spaced together than necessary on an actual roof assembly or in other Figures, such as at every upper rib, etc., to show multiple exemplary fasteners in less space, in relation of various other roofing elements, etc. The Figures are discussed together.

The corrugated steel roof deck 12 has corrugations creating upper ribs 22 and lower ribs 24 extending longitudinally along the deck panel. Corrugated deck 12 has substantially horizontal upper and lower rib portions, respectively, and pitched connector portions extending therebetween. The corrugations provide straight, parallel, and in the case of symmetrical corrugated decking, regular upper and lower ribs. The upper ribs provide flat upper surfaces useful for attaching built-up layers. The dimensions of the corrugations vary depending on anticipated loads, span, etc. Commonly available steel deck comes in 6 inch pitch steel sections, for example. Typical corrugated steel decks are made of 22 to 18 gauge steel, sometimes higher. A corrugated steel roof deck is attached to and supported by horizontal supports. The corrugated steel roof deck defines a plurality of alternating upper and lower ribs and has sufficient strength to withstand, considered alone, predetermined gravity, wind uplift, and diaphragm shear loads on the roof assembly.

Insulation layers 16 are positioned above the roof deck. The insulation is typically sheet material and applied as adjacent panels 26. The insulation may be rigid or flexible but does not act as a structural member of the roof assembly. The insulation is typically attached directly to the roof deck by threaded fasteners. Insulation materials are widely known in the art and commercially available, such as foamed polystyrene, perlite, fiberglass, polyisocyanurate, and wood fiber. Insulation panels are commercially available, such as those sold by GAF, JM, Rmax, Siplast and most roofing manufacturers.

Individual insulation panels 26 have opposed ends 32 and sides 34. When positioned on a roof deck, the panels are positioned abutting one another along their ends and/or sides and define insulation seams or joints 36 therebetween. Typically, the side and end surfaces of the insulation panels is square cut.

The roof deck assembly includes a rigid sheet material acting as a rigid substrate. The rigid substrate 18 is made up of a plurality of rigid substrate boards 28 which are relatively smooth, incombustible, and often water resistant. The rigid substrate boards are typically referred to as, or comprise, "mineral boards" (regardless of actual mineral content). The rigid boards can be made of plastic, gypsum or natural material, or cement, for example. In an embodiment, the rigid substrate boards are made substantially of gypsum, providing a high heat capacitance. Other materials can be used.

In an embodiment, the rigid substrate boards 28 are fiberglass-reinforced, providing additional strength, especially under flexural loading. Reinforcement, such as fiberglass reinforcement, allows the rigid board to bend and conform to the uneven surface of the steel deck. Without the reinforcement, the board tends to crack when forced to conform to the uneven roof surface. The boards, in an embodiment, provide resistance to high impact, moving and concentrated loads without rupturing. The boards can be high-density, for example, providing 400 psi strength in compression. The boards can also have high permeability, such as those rated at 16 perms. For example, the rigid substrate can be of Loadmaster Duraflex mineral board, commercially available from Loadmaster Dealers located nationwide.

In an embodiment, the rigid substrate board meets or exceeds the performance criteria in ASTM Specification C-79. In accordance with accepted criteria governing design of roofing substrates, the mineral board may not in itself be waterproof. The board can be designed to allow for proper transmission of water vapor and a degree of moisture migration so that water, which might enter the substrate during initial construction or subsequent leaks, can be quickly dissipated without creating an excessive build-up of vapor pressure which can be detrimental to adhered membranes.

The rigid layer 18 comprises a plurality of rigid substrate boards 28 having opposed ends 42 and opposed sides 44. The substrate boards 28 are positioned adjacent to one another and above the corrugated steel deck 12. In an embodiment, the substrate boards 28 are positioned end-to-end and side-to-side. Adjacent substrate boards 28 define butt or end joints 46 at adjacent ends 42 and side joints 48 at adjacent sides 44. ("Butt joints" and "end joints" are used interchangeably herein.)

Each butt joint 46 is, in an embodiment, positioned parallel to and above a corresponding upper rib 22 of the corrugated roof deck 12. In such a manner, the end joint lies above and is supported by an upper rib along the joint's length.

In some embodiments, the substrate boards 28 are positioned in rows across the roof deck. The end joints 46 in any given row are staggered from (not aligned with) the end joints 46 of adjacent rows, as best seen in FIG. 2. In such an arrangement, a butt joint 46 in one row is attached to a corresponding upper rib 22 of the roof deck 12, while an end joint 46 in an adjacent row is attached to a different upper rib 22. The staggered arrangement further stabilizes the rigid substrate layer from relative movement.

The substrate boards can be any size, with commonly available sizes of 4 feet by 4 feet, 4 feet by 8 feet, and 4 feet by 12.5 feet (12 feet and 6 inches). Of these, the optimum size is 12.5 feet because larger boards reduce the linear feet of side joints that must be stabilized, minimize the number of end joints that must be stabilized, and minimize the number of fasteners required. Further, the length of the 12.5 foot boards aligns with the spacing of upper ribs on commonly used corrugated steel roof decking. That is, the length of a 12.5 foot board is a multiple of the distances between upper ribs for each of 2½, 3¾, and 6 inch pitch steel sections. Consequently, when one end of a 12.5 foot board is placed above an upper rib, the opposite end will also fall at an upper rib.

The substrate boards 28 at each end joint 46 are secured to the corresponding upper rib 22 therebelow by a plurality of butt or end joint fasteners 50 spaced along the butt joint 46. In an embodiment, the end joint fasteners 50 are compression load stabilizers or fasteners. The end joint fasteners 50 compress the two adjacent board ends 42 to a single upper rib 22 which stabilizes the ends 42 of the boards to the rib. The compression load, end joint fasteners 50 in an embodiment are threaded fasteners 52 with a compression disk 54. The compression disk can be monolithic with or a separate piece from the fastener. The disk is slightly concave and is flattened during firm attachment into the upper rib 22. The end joint fasteners 50 are positioned in the butt joint formed between the two board ends 42, attach to a single upper rib, and act to fasten the board ends 42 together and to the upper rib 42. Alternative compression fasteners are known in the art and can be used. For a 4 foot long end joint, in an embodiment, four compression fasteners are required, spaced evenly along the butt joint. Spacing along the joint is determined based upon specified wind uplift loads and may vary. Joint tape 66 can be applied at the substrate board joints and over the joint fasteners 50 or other fasteners as desired.

In an alternative arrangement, two threaded fasteners 52 can be inserted directly across the butt joint 46 from each other, each located ¾ inch from the joint and into the single upper rib supporting both boards. This anchors the two board ends to a single upper rib. At the corners of the boards, three such screws would be required, one in each of the two board ends and an additional one in the adjoining third board side, located ¾ inch from the third board side. This alternative method requires additional fasteners over the method using compression fasteners. For example, where four compression fasteners are required along an end joint, five sets of non-compression fasteners will be required along a similar end joint. This would yield five fastened locations, created by 12 fasteners, across the 4 foot board ends (with ten of the twelve fasteners on the two adjacent boards forming the joint and two fasteners on adjoining boards). Spacing along the joint is determined based upon specified wind uplift loads and may vary.

The substrate boards 28 at each side joint 48 bridge across multiple upper ribs 22. The substrate boards 28 are secured to the multiple upper ribs 22 by a plurality of spaced apart fasteners 56 attaching the substrate boards 28 to the corrugated steel roof deck along the side joints. The fasteners 56 are preferably threaded fasteners such as screws. In an embodiment, the plurality of fasteners 56 are not positioned in the side joint but rather proximate to and spaced from the side joint a distance, such as ¾ inches, for example. A plurality of the fasteners 56 are spaced along the side of each board and attach the boards to the roof deck.

In an embodiment, the sides 44 of the substrate boards 28 define interlocking joints, such as tongue-and-groove joints. That is, the side of one board provides a tongue structure which interlocks with a groove defined in the side of an adjacent substrate board. In such an embodiment, the edges of the substrate boards provide continuous interlocking to create a barrier against bitumen leakage, to minimize joint movement under moving and concentrated loads, and to provide a resistance to wind up-lift forces. Other interlocking joints are known in the art and can be used. Where an interlocking joint is utilized, it is preferred that the side joint fasteners 56 be positioned other than in the joint. Alternately, no interlocking joint can be used. Where no interlocking joint is used, it is possible to utilize compression load fasteners or alternative methods as described above.

In an embodiment, a plurality of wind uplift resistance fasteners 60 are provided attaching the substrate boards to the roof deck 12. In an embodiment, the wind uplift resistance fasteners are threaded fasteners such as screws and incorporate generally flat plates forced against the upper surface of the boards 28 by application of the fasteners to the roof deck. In an embodiment, the wind uplift resistance fasteners 60 are spaced from the edges of the substrate boards and positioned towards the center of the board as shown. Spacing is determined based upon specified wind uplift loads and may vary.

In an embodiment, a plurality of thermal movement fasteners 64 are provided attaching the substrate boards to the roof deck 12 in the upper rib located immediately after the upper rib on which the butt joint occurs. Thermal movement fasteners are spaced across the board ends in the frequency required to provide thermal restraint and limit board joint movement from expansion and contraction due to temperature changes. In an embodiment, the thermal movement stabilizers or fasteners are threaded fasteners such as screws. In an embodiment, the thermal movement fasteners are proximate to but spaced from the ends of the substrate boards as shown. For example, the thermal fasteners can be spaced 6 inches from the board end and located across the board end in sufficient locations to restrict movement.

In use, the following methods can be utilized to build a substantially flat and horizontal roof deck assembly. The roof deck is positioned above, supported by, and attached to horizontal supports such as purlins, joists, and the like. The roof deck is high-strength steel and can be generally flat or corrugated, having upper and lower ribs. The roof deck is of sufficient strength to withstand specified or preselected loads when considered alone, and not only when considered in composite with additional roof assembly layers. That is, the roof deck assembly is a non-composite (i.e., not a composite) strength roof deck assembly.

One or more layers of insulation can be positioned above the roof deck and attached thereto. Attachment can be by fasteners as is known in the art, in particular threaded fasteners such as screws. The insulation layer can be comprised of a plurality of insulation panels positioned adjacent one another and meeting at insulation joints. Additionally, the insulation panels in some embodiments are positioned in adjacent rows, with the butt joints defined on one row of insulation panels staggered or off-set from the butt joints formed on an adjacent row of insulation panels.

A rigid substrate layer is positioned above the roof deck and, if present, insulation layer. The rigid substrate is comprised of a plurality of rigid substrate boards (e.g., mineral boards) positioned adjacent one another, defining joints between adjacent boards. The boards can be considered to have opposed ends and opposed sides, and thus when positioned on the roof deck assembly, creating (end) butt joints and side joints. In some embodiments, each butt joint is positioned above a single upper rib of the roof deck. The side joints, therefore, are positioned bridging across multiple upper ribs of the roof deck.

Additionally, adjacent board sides can be interlocked to one another or positioned together to form interlocking joints. That is, the sides of adjacent rigid boards, in some embodiments, define interlocking joints, such as tongue-and-groove joints. In such an embodiment, the sides of the substrate boards create continuous interlocking joints and create a barrier against bitumen and adhesive leakage, minimize joint movement under moving and concentrated loads, and provide resistance to wind up-lift.

Additionally, the rigid boards in some embodiments are positioned in adjacent rows, with the butt joints defined on one row staggered or off-set from the butt joints formed on an adjacent row. Further, the rigid boards can be positioned such that butt joints and/or side joints of adjacent rigid boards are staggered or off-set from the butt and/or side joints of the insulation panel layer below.

The rigid substrate is attached by fasteners to the roof deck. The fasteners can be threaded fasteners such as screws. In some embodiments, multiple fastener types are used for differing purposes and attached at different locations on the boards. In some embodiments, butt joint fasteners comprise compression load stabilizers or fasteners. Such butt joint fasteners are positioned in the butt joint defined between two adjacent board ends and to an upper rib of the roof deck, thereby stabilizing the ends of the boards to the rib. Compression load fasteners in some embodiments are threaded fasteners with a compression disk. The compression disk is flattened during attachment of the butt joint fastener into the upper rib and applies a positive downward force against the rigid boards.

Additionally, the method can include attachment of additional fasteners through the rigid boards and to the roof deck. A plurality of side joint fasteners can be positioned along the length of, proximate to, and spaced part from, the side joints. The plurality of side joint fasteners are each secured to an upper rib of the roof deck. The side joint fasteners are preferably threaded fasteners such as screws.

Additionally, a plurality of wind uplift resistance fasteners can be attached to the rigid substrate boards and the roof deck. In an embodiment, the wind uplift resistance fasteners are threaded fasteners such as screws and incorporate generally flat plates forced against the upper surface of the boards by application of the fasteners to the roof deck. In an embodiment, the wind uplift resistance fasteners are positioned proximate the center of the boards.

Additionally, in some embodiments, a plurality of thermal movement fasteners are attached to the substrate boards and the roof deck. In some embodiments, the thermal movement fasteners are positioned proximate to but spaced from the ends of the substrate boards.

The invention is defined by the claims appended hereto and the specification is not limiting to the claim interpretation. It is understood that other and further embodiments of the disclosed methods can be devised without departing from the basic concepts explained herein. Terms take their normal and ordinary meanings unless otherwise addressed herein. The various steps, actions, procedures, etc., described herein are limited in their respective order only when so indicated by the claims. Further, such actions can be omitted, repeated, changed in order, etc., as a person of skill in the art will recognize. Application of common sense by someone of skill in the art should educate use of the disclosed methods and any modifications thereof.

I claim:

1. A substantially horizontal, built-up roof assembly providing a stabilized layer of rigid substrate boards for prolonging the life of an overlying roof covering membrane, the assembly comprising:

a corrugated steel roof deck defining a plurality of alternating upper and lower ribs and having sufficient strength, by itself and without reliance on combined strength characteristics of multiple roof assembly components to meet load requirements, to withstand predetermined gravity, wind uplift, and diaphragm shear loads on the roof assembly, the steel roof deck of 2½, 3¾, or 6 inch pitch;

a plurality of rigid substrate boards each having opposed ends and opposed sides and opposed faces, the rigid substrate boards positioned adjacent other rigid substrate boards of the plurality of rigid substrate boards and above the roof deck, adjacent said rigid substrate boards defining end joints at adjacent ends and side joints at adjacent sides, the rigid substrate boards prone to relative movement upon application of stress to the roof deck assembly, the rigid substrate boards meeting or exceeding the performance criteria in ASTM Specification C-79;

wherein the rigid substrate boards have a reinforced core rated at 400 psi in compressive strength, the rigid substrate boards bending to conform to an uneven surface of the steel deck or as the roof deck moves under loading;

the rigid substrate boards having a length of 12.5 feet, the length of each rigid substrate board extending a multiple of the distances between upper ribs of the steel roof deck, reducing the linear feet of rigid substrate board side joints, and reducing the number of rigid substrate board end joints;

wherein the rigid substrate boards are positioned in adjacent rows, and wherein the end joints of a first row are positioned staggered from the end joints of a second, adjacent row;

each of the end joints positioned parallel to and above a corresponding upper rib of the corrugated roof deck, the rigid substrate boards at each end joint secured to the corresponding upper rib by a plurality of compression disk fasteners spaced along and positioned in the end joint and penetrating the corresponding upper rib below the end joint, with one of the plurality of compression disk fasteners positioned in the end joint at each corner of the rigid substrate board;

the end joints comprising butt joints, wherein each rigid substrate board defines opposing end walls which are perpendicular to opposing faces of the rigid substrate boards;

the side joints comprising tongue and groove joints, each of the side joints positioned to span across multiple upper ribs of the roof deck;

a plurality of spaced apart side joint fasteners attaching the rigid substrate boards to the roof deck along the side joints, the side joint fasteners proximate to but spaced apart from the side joints, the side joint fasteners and the compression disk fasteners minimizing relative movement of the rigid substrate boards at the joints between the rigid substrate boards;

a plurality of wind uplift resistance fasteners attaching the rigid substrate boards to the roof deck, the wind uplift resistance fasteners proximate the center of the rigid substrate boards and the wind uplift fasteners comprising a threaded fastener and a generally flat plate; and a plurality of thermal movement fasteners attaching the rigid substrate boards to the roof deck, the thermal movement fasteners spaced from the ends of the rigid substrate boards, the thermal movement fasteners extending adjacent to the compression disk fasteners;

an insulation layer interposed between the corrugated roof deck and the rigid substrate boards, wherein the insulation layer is comprised of a plurality of insulation panels positioned adjacent one another, insulation seams defined by adjacent insulation panels, the insulation seams offset from the rigid substrate board joints; and a roof covering membrane fully adhered to an upper surface defined by the plurality of rigid substrate boards, the membrane protected against failure by the minimizing of relative movement of the rigid substrate boards.

2. The roof assembly of claim 1, wherein the roof deck is high-strength steel.

3. The roof assembly of claim 1, wherein the roof covering membrane is of rubber, plastic, thermoplastic, or modified bitumen.

4. The roof assembly of claim 1, wherein the rigid substrate boards are 4 feet by 12.5 feet, and wherein at least some of the rigid substrate boards are positioned with a first end above a first upper rib of the roof deck and a second end above a second upper rib of the roof deck.

5. A method of retrofitting a substantially horizontal, pre-existing roof assembly having a corrugated steel deck defining a plurality of alternating upper and lower ribs, to create a non-composite strength roof assembly, the method comprising:

removing pre-existing roof coverings and insulation from the roof deck, the roof deck having sufficient strength alone and without composite structural strength provided by attachment to other roofing layers to withstand predetermined gravity, diaphragm, wind uplift, and diaphragm shear loads on the roof assembly;

positioning, adjacent to one another, a plurality of rigid substrate boards above the roof deck, the rigid substrate boards having opposed sides and opposed ends and opposed faces, with the rigid substrate boards defining end joints at adjacent ends and defining side joints at adjacent sides, the rigid substrate boards defining a generally flat upper surface, the rigid substrate boards meeting or exceeding the performance criteria in ASTM Specification C-79, wherein the rigid substrate boards have a reinforced core and are rated to 400 psi in compression;

positioning each of the side joints to span across multiple upper ribs of the roof deck;

positioning each of the end joints parallel to and above a corresponding upper rib of the roof deck;

positioning the rigid substrate boards in adjacent rows, and wherein the end joints of a first row are positioned staggered from the end joints of a second, adjacent row;

abutting adjacent ends of the rigid substrate boards at butt joints, wherein each rigid substrate board defines opposing end walls which are perpendicular to opposing faces of the rigid substrate boards;

attaching the rigid substrate boards at along each end joint to the corresponding upper rib of the roof deck with a plurality of end joint fasteners, the end joint fasteners comprising compression disk fasteners, and positioning the plurality of compression disk fasteners in the end joint between adjacent rigid substrate boards, and positioning one compression disk fastener at each corner of each rigid substrate board; and abutting adjacent sides of the rigid substrate boards along tongue and groove joints;

attaching the rigid substrate boards to the roof deck along the side joints using a plurality of spaced apart side joint fasteners, the side joint fasteners proximate to but spaced apart from the side joints;

attaching the plurality of rigid substrate boards to the roof deck with a plurality of wind uplift resistance fasteners, the wind uplift resistance fasteners proximate the center of the rigid substrate boards and the wind uplift fasteners comprising a threaded fastener and a generally flat plate;

attaching a roof covering membrane to an upper surface defined by the rigid substrate boards by fully adhering the roof covering membrane to the upper surface of the rigid substrate boards; and minimizing relative movement of the rigid substrate boards at the joints between the rigid substrate boards using the side joint fasteners along the side joints between the rigid substrate boards and the compression disk fasteners positioned in the end joints between the rigid substrate boards.

6. The method of claim 5, wherein the membrane is of rubber, plastic, thermoplastic, or modified bitumen.

* * * * *